US011247461B2

(12) United States Patent
Negishi et al.

(10) Patent No.: US 11,247,461 B2
(45) Date of Patent: Feb. 15, 2022

(54) RECORDING ELEMENT SUBSTRATE, LIQUID EJECTION HEAD AND RECORDING APPARATUS

(71) Applicant: CANON KABUSHIKI KAISHA, Tokyo (JP)

(72) Inventors: Toshio Negishi, Yokohama (JP); Suguru Taniguchi, Kawasaki (JP); Kazunari Fujii, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/723,955

(22) Filed: Dec. 20, 2019

(65) Prior Publication Data

US 2020/0207089 A1 Jul. 2, 2020

(30) Foreign Application Priority Data

Dec. 28, 2018 (JP) ..... JP2018-247776

(51) Int. Cl.
*B41J 2/14* (2006.01)
*B41J 2/16* (2006.01)

(52) U.S. Cl.
CPC ..... *B41J 2/14072* (2013.01); *B41J 2/14024* (2013.01); *B41J 2202/20* (2013.01)

(58) Field of Classification Search
None
See application file for complete search history.

(56) References Cited

U.S. PATENT DOCUMENTS 7,157,782 B1 * 1/2007 Shih ..... H01L 27/0203 257/50
2009/0079799 A1 * 3/2009 Sato ..... B41J 2/0451 347/68
2011/0080765 A1 * 4/2011 Groepl ..... G11C 17/18 365/96
2012/0314492 A1 * 12/2012 Shin ..... G11C 13/00 365/163
2014/0022855 A1 * 1/2014 Jang ..... G11C 11/5692 365/189.07
2018/0061506 A1 * 3/2018 Fujii ..... B41J 2/14153
2018/0281390 A1 * 10/2018 Fujii ..... B41J 2/04511

FOREIGN PATENT DOCUMENTS

CN 86101096 A 10/1986
CN 102529459 A 7/2012
CN 103578559 A 2/2014
CN 104051014 A 9/2014
JP 2014-58130 A 4/2014

* cited by examiner

*Primary Examiner* — Erica S Lin
*Assistant Examiner* — Tracey M McMillion
(74) *Attorney, Agent, or Firm* — Canon U.S.A., Inc. IP Division

(57) ABSTRACT

A recording element substrate for a liquid ejection head is provided with a storage section including an antifuse element and a first resistor connected in parallel with the antifuse element, and a second resistor that is connected in parallel with the storage section and serves as a reference in rating information of the antifuse element, and a second switch connected to the second resistor.

12 Claims, 10 Drawing Sheets

RECORDING ELEMENT SUBSTRATE, LIQUID EJECTION HEAD AND RECORDING APPARATUS

BACKGROUND OF THE INVENTION

Field of the Invention

The present disclosure relates to a recording element substrate for a liquid ejection head, the liquid ejection head and a recording apparatus.

Description of the Related Art

In general, a recording element substrate mounted on a liquid ejection head includes one time programmable (OTP) ROM for recording unique information such as product information and setting information. As an example of OTPROM, one of a fuse element and an antifuse element is used. Japanese Patent Application Laid-Open No. 2014-58130 describes, as OTPROM including an antifuse element, an example in which a resistor element is connected in parallel with the antifuse element in order to prevent erroneous recording.

In a configuration described in Japanese Patent Application Laid-Open No. 2014-58130, the resistance value of the resistor element connected in parallel with the antifuse element in order to prevent erroneous recording may deviate from a predetermined value causing a faulty reading of the antifuse element.

SUMMARY OF THE INVENTION

The present disclosure features a recording element substrate for a liquid ejection head, the recording element substrate including a storage section having an antifuse element and a first resistor connected in parallel with the antifuse element, and a first switch connected to the storage section, and a second resistor that is connected in parallel with the storage section and serves as a reference in rating information of the antifuse element, and a second switch connected to the second resistor.

Further features of the present disclosure will become apparent from the following description of exemplary embodiments with reference to the attached drawings.

DESCRIPTION OF THE EMBODIMENTS

An aspect of the present disclosure is to provide a recording element substrate that can reduce the occurrence of faulty readings of an antifuse element.

The recording element substrate for a liquid ejection head, the liquid ejection head and a recording apparatus according to the present disclosure will be described below with reference to the accompanying drawings. The recording element substrate of a thermal type will be described as an example of the present disclosure. The present disclosure is not limited to the thermal type and may be applied to a piezo-type recording element substrate for a liquid ejection head.

First Embodiment

Figure 10:
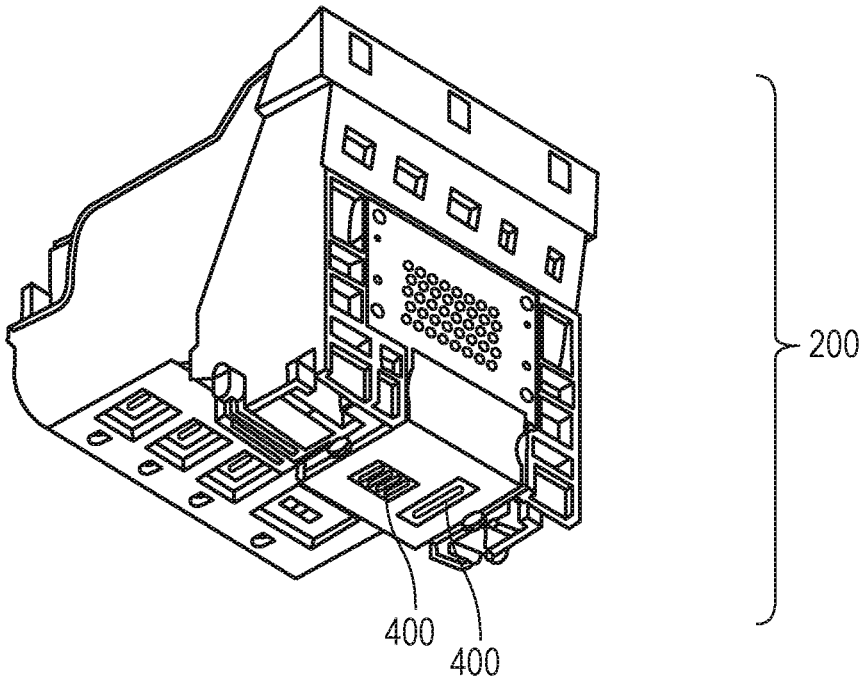
FIG. 10 is an overall perspective view of a liquid ejection head.

Referring to FIGS. 1 to 5 and 10, a first embodiment will be described below. FIG. 10 is a perspective view illustrating a liquid ejection head 200 according to the present embodiment. The liquid ejection head 200 has two recording element substrates 400. The recording element substrate 400 for the liquid ejection head 200 includes a heater (not illustrated) for heating a liquid, e.g., ink. Heat from the heater generates bubbles in ink and ejects the liquid from an ejection orifice (not illustrated).

(The Circuits of the Recording Element Substrate)

Figure 1:
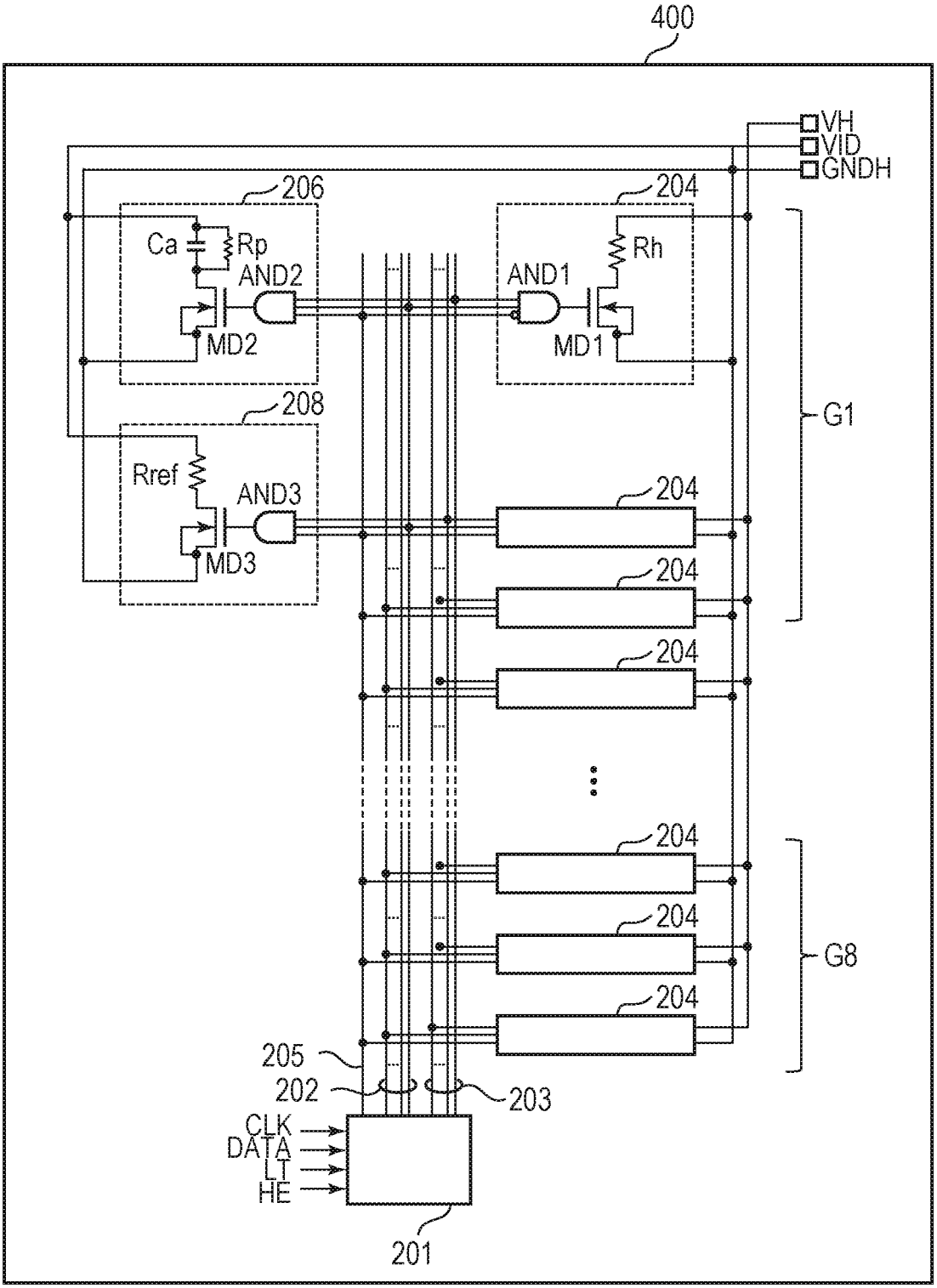
FIG. 1 illustrates a circuit configuration of a recording element substrate according to a first embodiment.
Figure 2:
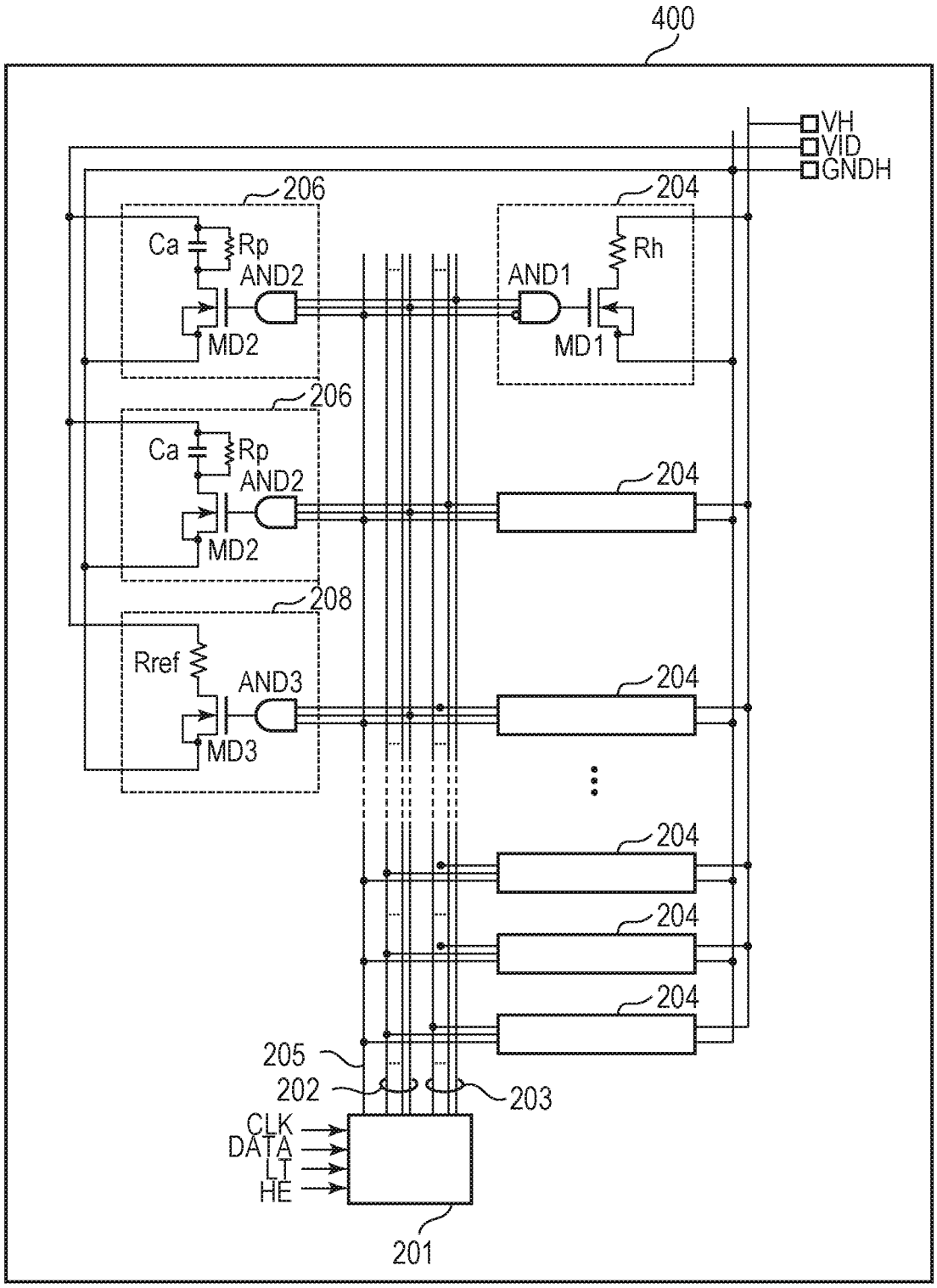
FIG. 2 illustrates a circuit configuration of the recording element substrate according to the first embodiment.

Referring to FIGS. 1 and 2, circuits formed on the recording element substrate will be described below. FIGS. 1 and 2 illustrate the circuit configurations of the recording element substrate 400 according to the present embodiment. FIG. 1 is an electric circuit diagram in which a memory module 206 is formed as a feature of the present disclosure on the recording element substrate. FIG. 2 is a circuit diagram in which a plurality of (two) memory modules 206 are formed. The recording element substrate includes a plurality of ejection modules 204, the memory module (storage section) 206, a memory correction module 208 and a control data supply circuit 201.

The ejection module 204 includes a pressure generating element (electrothermal transducer) Rh that generates energy for ejecting liquid from the ejection orifice (not illustrated) formed on the recording element substrate, a drive element MD1 for driving the pressure generating element Rh and a logic circuit AND1. The drive element MD1 is a MOS transistor in the present embodiment. In this configuration, the MOS transistor acts as a switch that determines whether a voltage is applied to the pressure generating element Rh. The logic circuit AND1 is an AND circuit for driving the drive element MD1 based on a signal from the control data supply circuit 201 and performs logical operations on a plurality of signals. The pressure generating element Rh is driven, that is, the pressure generating element Rh is energized to generate heat and bubbles are generated in ink so as to eject liquid from the ejection orifice, enabling recording. A power supply voltage VH (e.g., 24 V) is supplied to the pressure generating element Rh. A ground potential GNDH is supplied to the source of the MOS transistor MD1.

The memory module 206 includes an antifuse element Ca, a parallel resistance Rp (resistor) connected in parallel with the antifuse element Ca, a drive element MD2 for writing information in the antifuse element Ca and a logic circuit AND2. The antifuse element Ca holds information in a fixed manner by the supply of overvoltage. In other words, the antifuse element Ca acts as one time programmable (OTP) ROM that is programmable only one time. The antifuse element Ca is insulated before an overvoltage is supplied. When an overvoltage is supplied, the antifuse element Ca acts as a resistor element (resistor) and is energized. Thus, for example, the antifuse element Ca in an insulated state is rated as 0, whereas the antifuse element Ca in an energized state is rated as 1, enabling a memory function. The parallel resistance Rp is provided to prevent an overvoltage applied across the antifuse element Ca from a power supply voltage VID from causing erroneous writing of information in the antifuse element Ca even if the drive element MD2 is non-conducting. The drive element MD2 is, for example, a transistor. When information of 1 is recorded in the antifuse element Ca, the drive element MD2 is driven so as to apply a voltage to the antifuse element Ca. The applied voltage energizes the antifuse element Ca, so that the information of 1 is stored.

The power supply voltage VID (e.g., 24 V) is supplied to the antifuse element Ca and the ground potential GNDH is supplied to the source of the MOS transistor MD2.

Although the power supply voltage VID and the power supply voltage VH are on mutually independent lines, if the minimum value of a voltage required for writing in the antifuse element is not higher than the power supply voltage VH, the power supply voltage VH may be used along with, for example, a step-down circuit.

The memory correction module 208 includes a memory reference resistance Rref, a drive element MD3 for reading the memory reference resistance Rref, and a logic circuit AND3. In this configuration, the memory reference resistance Rref has the same resistance value as the parallel resistance Rp. The same resistance value means substantially the same resistance value, and the same resistance value holds even if there is a slight difference in resistance values due to a manufacturing error or the like. The memory correction module 208 is configured to reduce the occurrence of faulty reading of the antifuse element Ca, which will be specifically described later. The power supply voltage VID is supplied to the memory correction module 208 and the ground potential GNDH is supplied to the memory correction module 208. Although the power supply voltage VID and the power supply voltage VH are on mutually independent lines, if the minimum value of a voltage required for writing in the antifuse element Ca of the memory module 206 is not higher than the power supply voltage VH, the power supply voltage VH may be used along with, for example, a step-down circuit.

The control data supply circuit 201 is a circuit for driving the drive elements MD1, MD2 and MD3 and includes, for example, a shift register (not illustrated) and a latch circuit (not illustrated). Moreover, the control data supply circuit 201 includes a selection circuit that selects which one of the resistor element Rp or the resistor element Rref is to be subjected to voltage measurement during reading of the information of the antifuse element Ca, which will be described later. Alternatively, a circuit including a control data supply circuit, signal lines 202, 203 and 205 and a logic circuit may be referred to as a selection circuit. A clock signal (CLK), a data signal (DATA), a latch signal (LT) and a heat enable signal (HE) are input to the control data supply circuit 201 from the outside of the recording element substrate via the terminal of the recording element substrate. The data signal (DATA) includes information for selecting the ejection module 204, the memory module 206 and the memory correction module 208. The data signal (DATA) is serially input based on the clock signal (CLK).

The control data supply circuit 201 receives the data signal (DATA) and generates a block selection signal, a group selection signal and a switching signal based on the information included in the data signal (DATA). Based on these signals, the ejection module 204, the memory module 206 and the memory correction module 208 are selected and driven. To the logic circuits (AND1 to AND3), the control data supply circuit 201 supplies the block selection signal via the signal line 202, supplies the group selection signal via the signal line 203, and supplies the switching signal via the signal line 205.

In order to drive the modules 204, 206 and 208 in a time-sharing manner, as illustrated in FIG. 1, the multiple ejection modules 204 are divided into eight groups (G1, . . . , G8), each including three ejection modules. Furthermore, three blocks (1, 2 and 3) are allocated to the ejection modules 204 of each group. This can select and drive the modules 204, 206 and 208 in a time-sharing manner. Moreover, during reading of the antifuse element, which will be described later, access can be made to the memory module 206 and the memory correction module 208 in a time-sharing manner. In this case, the group selection signal is a signal for selecting which one of the groups is to be driven when the multiple ejection modules 204 are divided into the multiple groups. The block selection signal is a signal for selecting which one of the multiple pressure generating elements Rh in the same group is to be driven. The drive element MD1 is a double-diffused MOSFET (DMOS transistor) that is a MOS transistor capable of withstanding a high voltage.

In this embodiment, the multiple ejection modules 204 are divided into eight groups (G1, . . . , G8), each including three ejection modules. The present embodiment is not limited to this configuration. For example, the ejection modules may be divided into eight groups, each including 16 ejection modules.

The antifuse element Ca can be driven by using the signal line 202 and the signal line 203. At this point, the switching signal line 205 is used. The switching signal from the switching signal line 205 is used to switch between when to drive the antifuse element Ca and when to drive the ejection module 204. Thus, the block selection signal, the group selection signal and the switching signal are input to the logic circuit AND2 for the memory module. Subsequently, a signal (a control signal Sig in FIG. 3) corresponding to the input signal is output from AND2 to the drive element MD2 for the memory module, the antifuse element Ca is then driven, and the antifuse element Ca is transitioned from an insulated state to an energized state. The drive element MD2 for the memory module is made up of a DMOS transistor like the drive element MD1 for the ejection module. The logic circuit AND2 for the memory module is made up of a MOS transistor.

The block selection signal, the group selection signal and the switching signal are similarly input to the logic circuit AND3 for the memory correction module. Subsequently, a signal (the control signal Sig in FIG. 3) corresponding to the input signal is output from AND3 to the drive element MD3 for the memory correction module. The drive element MD3 for the memory correction module is made up of a DMOS transistor. The logic circuit AND3 for the memory correction module is made up of a MOS transistor.

Which one of the antifuse elements Ca of the memory modules 206 is to be chosen for writing information can be determined by the block selection signal, the group selection signal and the switching signal based on the signals CLK, DATA, LT and HE.

(Writing in the Antifuse Element)

Figure 3:
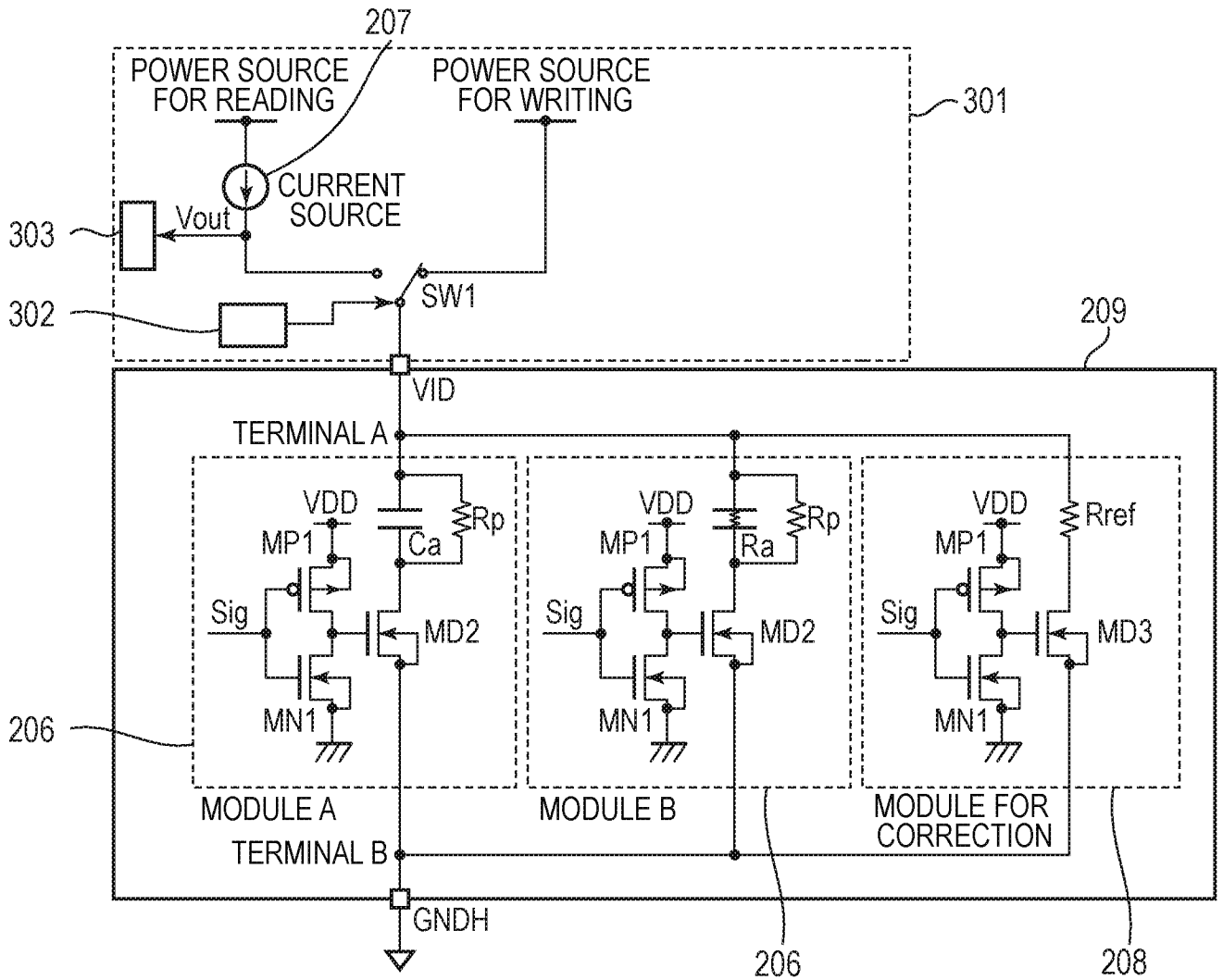
FIG. 3 illustrates a circuit configuration of the recording element substrate according to the first embodiment.

Referring to FIG. 3, a writing operation will be described below. FIG. 3 is an explanatory drawing of a configuration including the two memory modules 206. FIG. 3 illustrates the circuit configuration of the recording element substrate 400 and a recording apparatus 301 according to the present embodiment. Transistors MP1 and MN1 in FIG. 3 indicate a part of the configuration of the logic circuit AND2. The recording apparatus 301 includes a control unit 302 and a judgment section 303. The control unit 302 controls the operation of the recording element substrate 209. The judgment section 303 determines whether the antifuse element Ca is insulated or not. Moreover, the control unit 302 controls the recording apparatus 301 based on the determination result of the judgment section 303.

In addition to switching of SW1, the control unit 302 enables the generation of the clock signal (CLK), the data signal (DATA), the latch signal (LT) and the heat enable signal (HE) that are output to the control data supply circuit 201. The control unit 302 is made up of, for example, a CPU or an ASIC.

A terminal A is connected to a writing power supply installed in an inkjet recording apparatus or the like and a terminal B is connected to a ground installed in an inkjet recording apparatus or the like. When information is to be written in the antifuse element, the memory drive element MD2 is turned on by inputting a low-level signal as the control signal Sig. Thus, a high voltage VID is applied to a gate oxide film constituting the antifuse element Ca. This breaks the gate oxide film and brings the antifuse element Ca into conduction of electricity, achieving writing of information. The antifuse element Ca acts as a capacitance element before writing, whereas the antifuse element Ca acts as a resistor element Ra after writing. In the two memory modules 206, a memory module A indicates a state in which information is not written in the antifuse element Ca (in the absence of dielectric breakdown). A memory module B indicates a state in which information is written in the antifuse element and the antifuse element acts as the resistor element Ra (in the presence of dielectric breakdown).

(Reading Operation)

Referring to FIG. 3, an operation during reading of information recorded in the antifuse element Ca will be described below. FIG. 3 illustrates the circuit configuration of the recording element substrate and the recording apparatus according to the present embodiment. For explanation, the ejection modules 204 or the like in FIGS. 1 and 2 are omitted in FIG. 3. The terminal A in FIG. 3 is connected to a current source 207 installed in a recording apparatus or the like and the terminal B is connected to a ground installed in a recording apparatus or the like. The memory correction module 208 is connected in parallel with the memory modules 206.

In the present embodiment, when a constant current is supplied from the current source 207 to the terminal A, a Vout voltage generated on the terminal A is read by a recording apparatus or the like, so that a writing state of the antifuse element Ca is identified. First, in a state in which information is not written in the antifuse element Ca as in the memory module A, the antifuse element Ca is insulated. Thus, if the drive element MD2 has an on resistance value Rd2 and the current source 207 has a current value is, an output voltage Vouta is expressed by the following Formula 1:

$$Vout a = is \times (Rp + Rd2) \quad \text{(Formula 1)}$$

For example, in the case of is =30 μA, Rp=100 kΩ and Rd2=1 kΩ, the output voltage Vouta is about 3.0 V.

In a state in which information is written in the antifuse element Ca as in the memory module B, the antifuse element Ca acts as the resistor element Ra and thus if the memory drive element MD2 has the on resistance value Rd2, an output voltage Voutb is expressed by the following Formula 2:

$$Vout b = is \times ((Ra \times Rp)/(Ra + Rp) + Rd2) \quad \text{(Formula 2)}$$

For example, in the case of is =30 μA, Rp=100 kΩ, Rd2=1 kΩ and Ra=1 kΩ, the output voltage Voutb is 0.1 V or less.

If the drive element MD3 for the memory reference resistance has an on resistance Rd3, an output voltage Vref during reading of the memory correction module 208 is expressed by the following Formula 3:

$$Vref = is \times (Rref + Rd3) \quad \text{(Formula 3)}$$

For example, in the case of is =30 μA, Rref=100 kΩ and Rd3=1 kΩ, the output voltage Vref is about 3.0 V.

The writing state of the antifuse element Ca is identified by a judgment value D of the following Formula 4:

$$D = Vout/(Vref \times r) \quad \text{(Formula 4)}$$

where r is a variable for optionally determining a judgment threshold value. The judgment threshold value may be determined according to variations in resistance Ra after writing of the antifuse element Ca. Specifically, the maximum value of variations in Ra is about 20 kΩ during writing under a certain condition. If Rref has a center value of 100 kΩ, r=0.5 is set. At this point, the judgment values D of the memory modules A and B are determined as follows:

$$Da = Vout a/(Vref \times 0.5) = 3.0/(3.0 \times 0.5) = 2.0$$

$$Db = Vout b/(Vref \times 0.5) = 0.5/(3.0 \times 0.5) = 0.33$$

If the judgment value D is at least 1, the memory module is rated as unwritten, whereas if the judgment value D is less than 1, the memory module is rated as written. For example, the memory module A is rated as unwritten because a judgment value Da is at least 1. The memory module B is rated as written because a judgment value Db is less than 1. Although in this embodiment, the parallel resistance Rp and the memory reference resistance Rref are at the same value of 100 kΩ and a variable r is used for determination, Rref may be provided with such a resistance value that serves as a judgment threshold value and determination may be made by comparing Vout and Vref to see which is larger or smaller.

As described above, diffusion resistors are used for the parallel resistance Rp and the memory reference resistance Rref. The resistance value of the diffusion resistor considerably varies during manufacturing and greatly changes according to a temperature with a temperature coefficient of at least 1000 ppm/° C. For example, in the case of manufacturing variations of ±50% with a temperature characteristic of 4000 ppm/° C., the resistance value of the parallel resistance Rp is changed by 40% with a temperature change of 0 to 100° C. Thus, relative to a resistance value at 50° C., an output voltage is increased by 80% or is reduced by 60% according to manufacturing variations and temperature variations.

Figure 4A:
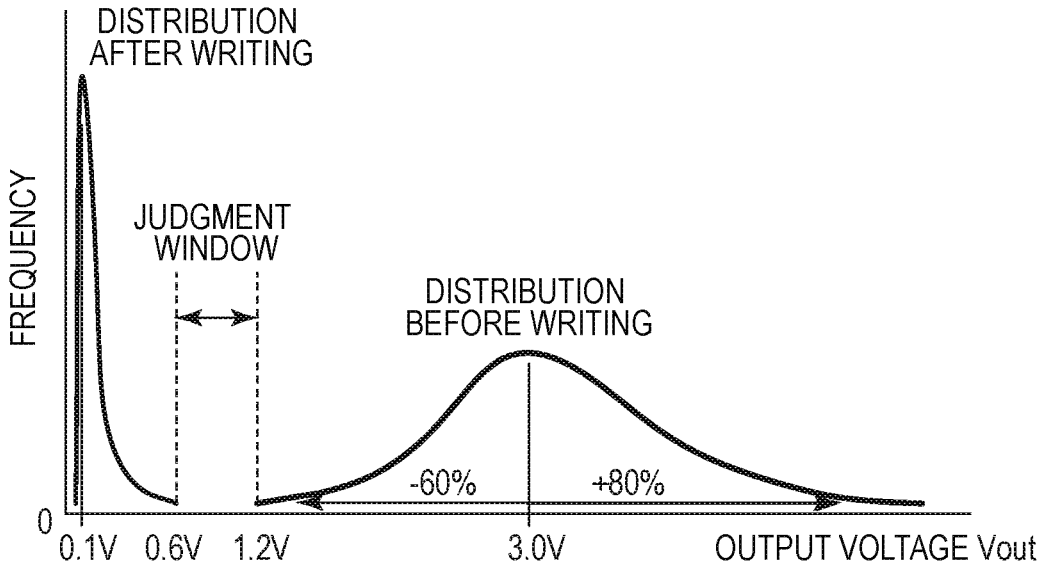
FIGS. 4A and 4B are schematic diagrams indicating a judgment region for confirming the presence or absence of recording of an antifuse element.

An impedance before writing of the antifuse element depends on the resistance value of the parallel resistance Rp and thus as indicated in FIG. 4A, the minimum output voltage Vouta before writing is 1.2 V relative to the center value of 3.0 V in consideration of manufacturing variations and a temperature change. The output voltage Voutb also varies after writing. An impedance after writing depends on the resistance value Ra of the antifuse element after writing and thus if the maximum variation is 20 kΩ, the output voltage Voutb reaches up to 0.6 V. A voltage difference of 0.6 V between the minimum value of Vouta and the minimum value of Voutb is a range where a writing-judgment threshold voltage can be set. The smaller the range, the lower the reliability during reading. Thus, the memory reference resistance Rref has the same configuration as the parallel resistance Rp in this embodiment. The memory reference resistance Rref is changed according to the resistance value of the parallel resistance Rp, thereby preventing a reduction in reliability. The same configuration specifically means the same diffusion resistor and more preferably a design having the same width and length. If the diffusion resistor has a resistance variation α, Vouta' and Vref are expressed by the following formulas 1' and 3':

$$Vout a' = is \times (\alpha \times Rp + Rd2) \quad \text{(Formula 1')}$$

$$Vref = is \times (\alpha \times Rref + Rd3) \quad \text{(Formula 3')}$$

If on resistances Rd2 and Rd3 of MD2 and MD3 are sufficiently small relative to the parallel resistance Rp and the memory reference resistance Rref, the resistance variation α is cancelled by (Formula 1') and (Formula 3') and thus the judgment value D based on the formulas is expressed by the following formula 4':

$$D = Vout a'/(Vref \times r) = Rp/(Rref \times r) \quad \text{(Formula 4')}$$

This formula proves that even if the parallel resistance Rp and the memory reference resistance Rref show variations, the variations cancel each other out in the absence of relative variations at the same temperature, so that the judgment value D does not depend on variations in parallel resistance Rp. In some inkjet recording patterns, some of the recording elements Rh may intensively repeat heat generation so as to bias a temperature distribution in the recording element substrate. Thus, in order to reduce a difference in resistance value between the parallel resistance Rp and the reference resistance Rref due to a temperature, it is desirable to dispose the parallel resistance Rp and the reference resistance Rref next to each other. For example, it is desirable that the reference resistance Rref be disposed for each group for time-division driving and during reading, the memory module be read to calculate the judgment value immediately after the closest memory correction module is read. In the absence of the adjacent memory correction module, the judgment value D may be determined by predicting a Vref value according to the read values of the two or more memory correction modules, the positional relationship of the modules and an estimated temperature distribution.

Figure 4B:
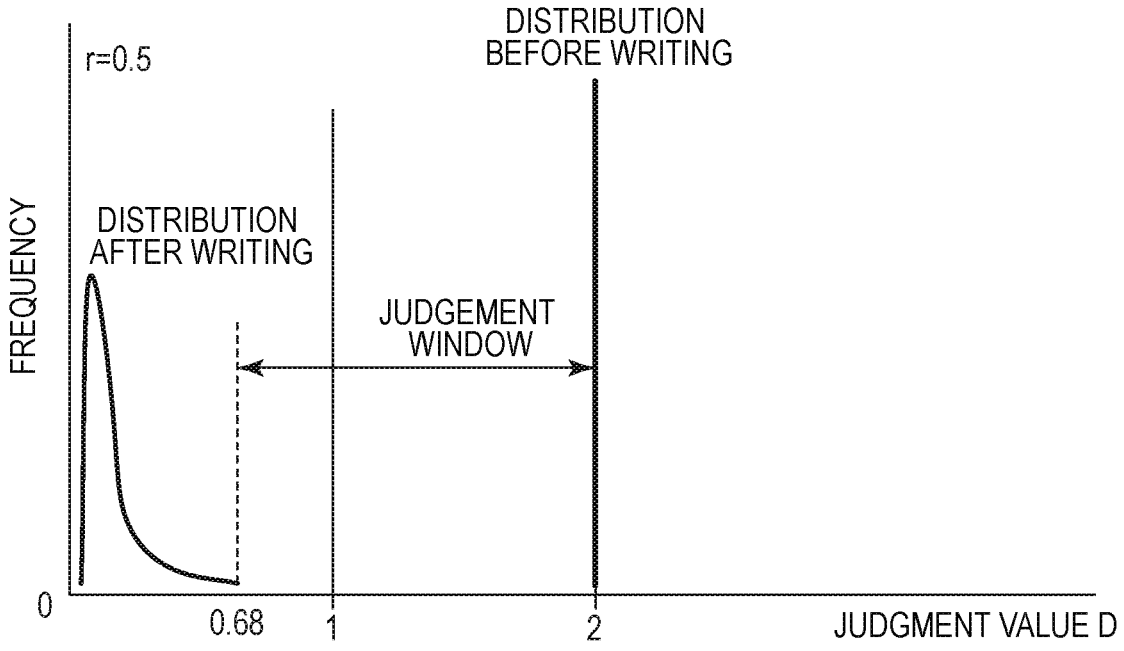

FIG. 4B indicates the distributions of the judgment value D in the case of r=0.5 before and after writing. As is evident from FIG. 4B, the judgment value D before writing does not vary in the case of Rp=Rref. The judgment value D after writing does not have the effect of cancelling the resistance variation α as before writing. This is because Vref depends on the resistance variation α of Rref, whereas Vout depends on a variation in the antifuse resistance value Ra after writing. However, the elimination of variations before writing is so effective that a writing judgment window is larger than that of the conventional method. This can considerably reduce the occurrence of faulty reading. In reality, variations in the characteristics of MD2 and MD3 also affect faulty reading but the variations are so small as to be managed relative to the variations of the diffusion resistor. Thus, the variations of MD2 and MD3 are not considered as a cause of faulty reading.

Furthermore, in the present embodiment, it is expected to have the effect of cancelling variations in the current value of a reading circuit, variations in read voltage, and variations in the parasitic resistances of a wire and an electric contact in order to compare the measured values of Vout and Vref.

The present embodiment described a circuit configuration in which a node connected to the memory module and a node connected to the memory correction module serve as the common terminals A and B. The nodes may be connected as different terminals to an inkjet recording apparatus or the like.

In the present embodiment, the recording element Rh is an electrothermal transducer but may be a piezoelectric element.

Figure 5:
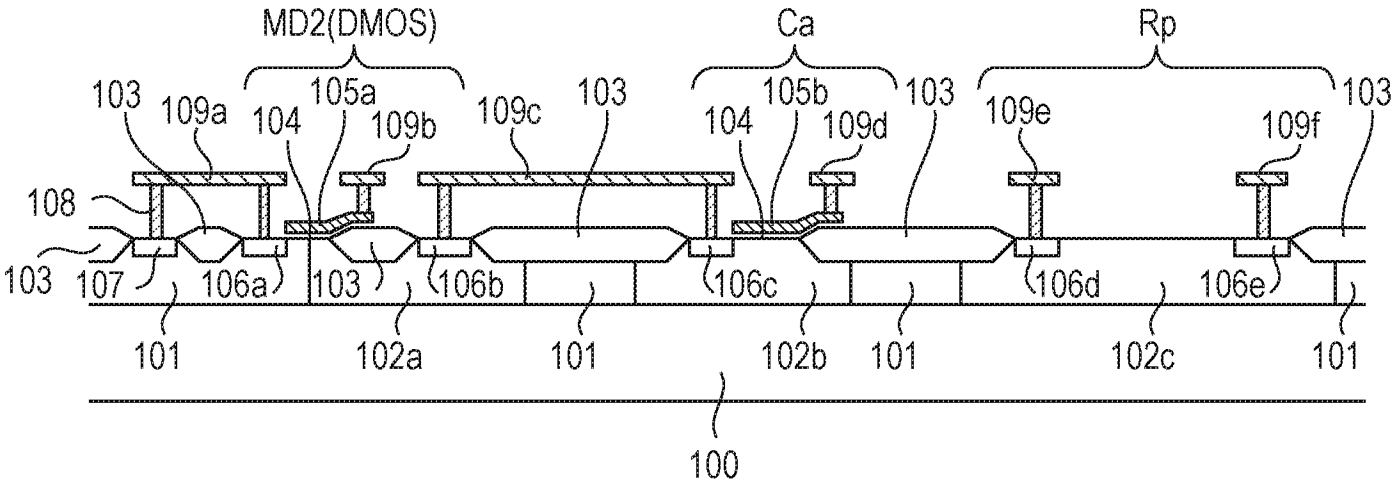
FIG. 5 is a cross-sectional view illustrating the recording element substrate according to the first embodiment.

FIG. 5 is a schematic diagram of an example of a device cross-section structure of a DMOS part corresponding to the antifuse element Ca, the parallel resistance Rp and memory drive element MD2. A P-well region 101 and N-well regions 102*a*, 102*b* and 102*c* are formed on a P-type silicon substrate 100. The P-well region 101 is a well identical to the P-well of an NMOS transistor constituting a low voltage logic circuit. The N-well regions 102*a* and 102*b* are wells identical to the N-well of a PMOS transistor constituting a low voltage logic circuit. Moreover, it is necessary to set an N-well impurity concentration relative to a substrate concentration such that the breakdown voltages of the N-well regions 102*a*, 102*b* and 102*c* relative to the P-type silicon substrate 100 are higher than the high voltage VID.

Reference numeral 103 denotes a field oxide film having a LOCOS structure. Reference numeral 104 denotes a gate oxide film that is formed in the step of the gate oxide film of a CMOS transistor constituting a low voltage logic circuit.

Reference numerals 105*a* and 105*b* denote polysilicon layers. Reference numeral 105*a* serves as the gate electrode of the high-voltage NMOS transistor MD2 and reference numeral 105*b* serves as the electrode of a capacitor acting as the antifuse element Ca. Reference numerals 106*a* to 106*e* denote high-concentration n-type diffusion regions. Reference numeral 107 denotes a high-concentration p-type diffusion region. The polysilicon layer, the high-concentration n-type diffusion regions and the high-concentration p-type diffusion regions are formed by the same steps as the steps of a CMOS transistor constituting a low voltage logic circuit.

Reference numeral 108 denotes a contact portion and reference numerals 109*a* to 109*d* denote metal wires. The manufacturing method and structures of the metal wires 109*a* to 109*d* and the electrodes are not limited as long as the metal wires and the electrodes are electrically connected to one another.

The configuration of the high-voltage NMOS transistor will be described below. The gate electrode 105*a* is disposed on the gate oxide film 104 over the P-well region 101 and the N-well region 102*a* adjacent to each other. An overlapping region between the P-well region 101 and the gate electrode 105*a* serves as a channel region. The high-concentration n-type diffusion region 106*a* is a source electrode and the high-concentration p-type diffusion region 107 is a back gate electrode. The N-well region 102*a* extending to the bottom of the gate electrode 105 is disposed as an electric field relaxation region for a drain. The high-concentration n-type diffusion region 106*b* formed in the N-well region 102*a* serves as a drain electrode. Furthermore, the drain side of the gate electrode 105*a* hangs over the field oxide film 103 formed in an N-well 102, presenting a so-called LOCOS offset structure. Thus, even if the high-voltage NMOS transistor is placed in an off state, that is, the gate electrode has a voltage GND and the voltage of the drain electrode rises to the high voltage VID, a gate-drain breakdown voltage can be obtained.

The structure of the antifuse element Ca will be described below. The electrode 105*b* is disposed on the gate oxide film 104 over the N-well region 102*b* as the upper electrode of the antifuse element Ca. The high-concentration n-type diffusion region 106*c* is disposed as the lower electrode on the N-well region 102*b*.

In FIG. 5, the high-concentration n-type diffusion region 106*c* is formed only in the opening of the upper electrode. The high-concentration n-type diffusion region may be formed over the bottom of the upper electrode. Moreover, in FIG. 5, the lower electrode of the antifuse element Ca is connected to the drain of the high-voltage NMOS transistor. The upper electrode may be connected to the drain of the high-voltage NMOS transistor and the lower electrode may be connected to the high voltage VID. FIG. 5 illustrates the capacitor formed by the N-well region and polysilicon. A capacitor including a PMOS transistor may be used instead.

The parallel resistance Rp will be described below. The parallel resistance Rp can be set at several tens kΩ or higher in order to increase a difference in impedance before and after writing. A diffusion resistor using diffusion is used as a high-resistance element. FIG. 5 illustrates the parallel resistance Rp including the diffusion resistor. The diffusion resistor includes the N-well region 102*c* and is connected to metal wires 109*e* and 109*f* via the high-concentration N-type diffusion regions 106*d* and 106*e*. Likewise, the memory reference resistance Rref also includes the diffusion resistor.

The connection states of the electrodes will be described below. The metal wire 109*a* is connected to the source electrode and the back-gate electrode of the high-voltage NMOS transistor via the contact portion 108 and receives a GND potential. The metal wire 109*b* is connected to the gate electrode of the high-voltage NMOS transistor via the contact portion 108 and receives an output signal Vg input from an inverter circuit illustrated in FIG. 1. The metal wire 109*c* is connected to the drain electrode of the high-voltage NMOS transistor MD2 and the lower electrode of the antifuse element Ca via the contact portion 108. The metal wire 109*d* is connected to the upper electrode of the antifuse element Ca via the contact portion 108 and receives the high voltage VID during writing.

Second Embodiment

Figure 6A:
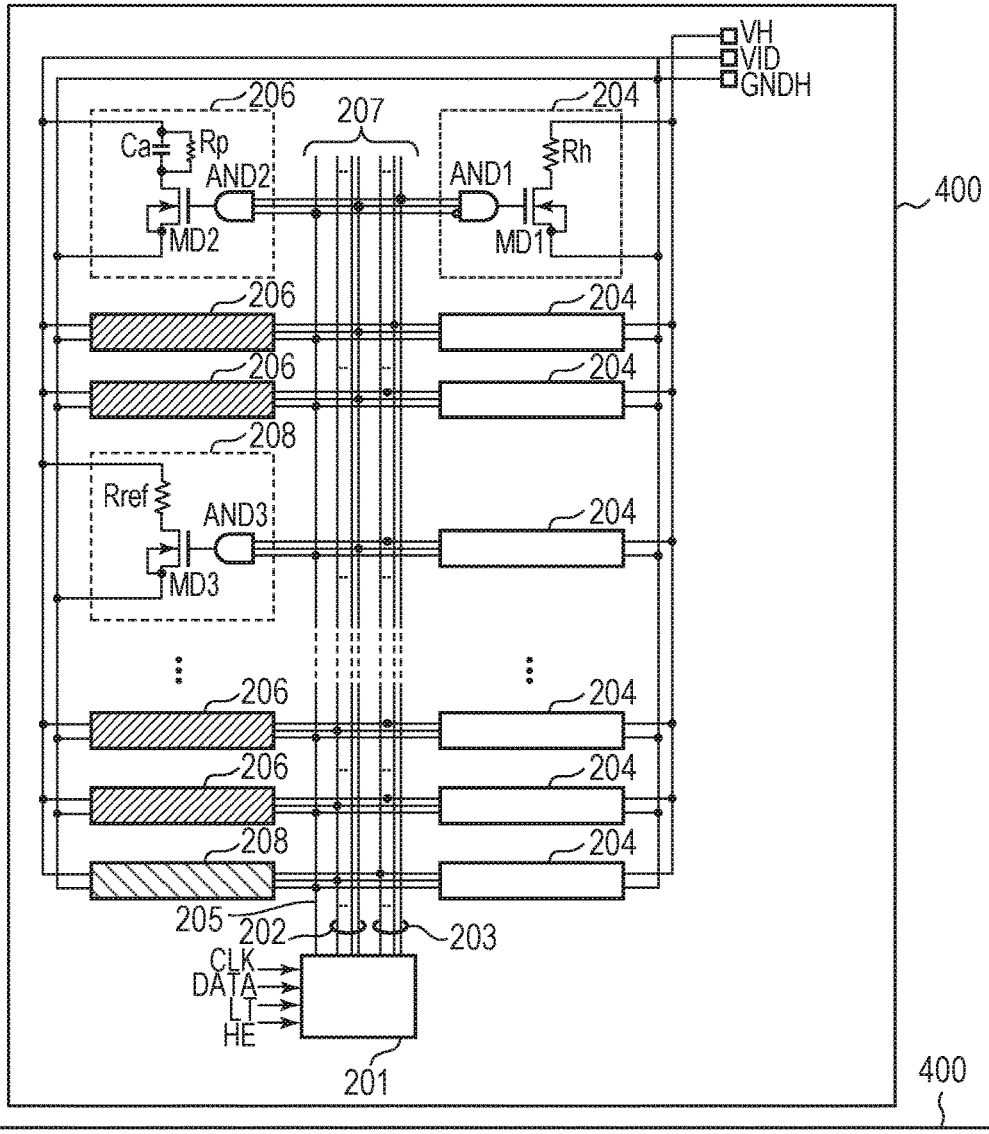
FIGS. 6A and 6B illustrate circuit configurations of a recording element substrate according to a second embodiment.
Figure 6B:
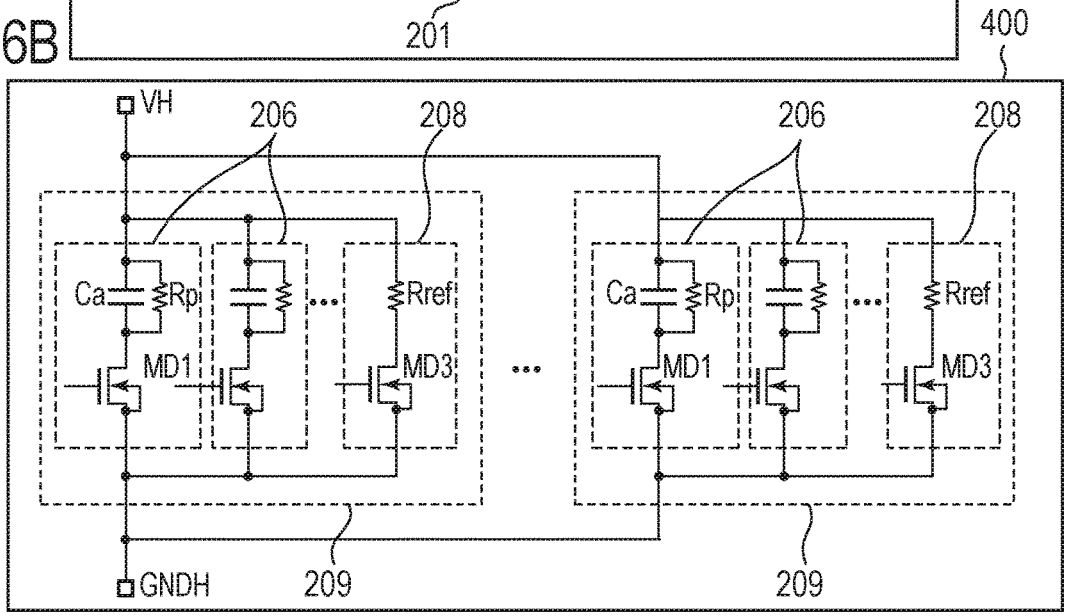

Referring to FIGS. 6A and 6B to FIGS. 8A and 8B, a second embodiment will be described below. As illustrated in FIGS. 1 and 2, the first embodiment described the configuration including the one or two memory modules 206 and the single memory correction module 208. In the present embodiment, as illustrated in FIGS. 6A and 6B, a plurality of module sets 209 are formed, the module set 209 including modules 204, 206 and 208. In other words, a recording element substrate 400 according to the present embodiment includes the two or more memory correction modules 208. A circuit configuration in each module is identical to the circuit configuration of the first embodiment and thus the explanation thereof is omitted. Moreover, a writing operation in an antifuse element Ca is identical to the writing operation of the first embodiment and thus the explanation thereof is omitted.

In response to the output signal of a control data supply circuit 201, the memory modules 206 and the memory correction modules 208 are controlled in each of y groups, the group including the x memory modules 206 and the at least one memory correction module. Specifically, each of the memory modules 206 receives at least one bit of a block selection signal through a signal line 202, a group selection signal through a signal line 203 and a switching signal through a signal line 205, thereby driving the antifuse element Ca in a time-sharing manner. Each of the memory correction modules 208 similarly receives at least one bit of the block selection signal, the group selection signal and the switching signal, thereby driving a memory reference resistance Rref in a time-sharing manner. At this point, one of the ejection module 204 and the memory module 206 is selected to be driven by the switching signal and a logical configuration is obtained such that all pressure generating elements Rh and all the antifuse elements Ca are not driven at the same time. Likewise, one of the memory correction module 208 and the ejection module 204 is selected to be driven by the switching signal and a logical configuration is obtained such that all the pressure generating elements Rh and all the memory reference resistances Rref are not driven at the same time.

In the case of the 1-bit switching signal, $x' \leq n$ is established where x' is the total number of antifuse elements Ca and memory reference resistances Rref in one memory group and n is the number of time-division selection signals and $y \leq m$ is established where y is the number of memory groups and m is the number of block selection signals. Alternatively, a recording element/the memory switching signal of multiple bits may be provided to control the antifuse elements Ca and the memory reference resistances Rref such that the number of antifuse elements Ca and memory reference resistances Rref exceeds ($n \times m$).

A reading operation will be described below. A basic reading operation is identical to the reading operation of the first embodiment. However, in the configuration including the multiple memory correction modules 208, writing of the memory module 206 may be determined in comparison with the closest memory correction module 208 in consideration of manufacturing variations and a temperature distribution in the recording element substrate.

Figure 7A:
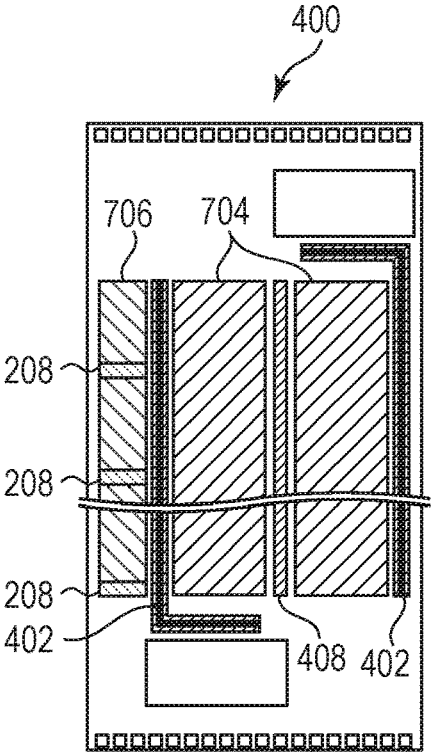
FIGS. 7A, 7B and 7C illustrate circuit configurations of the recording element substrate according to the second embodiment.
Figure 7B:
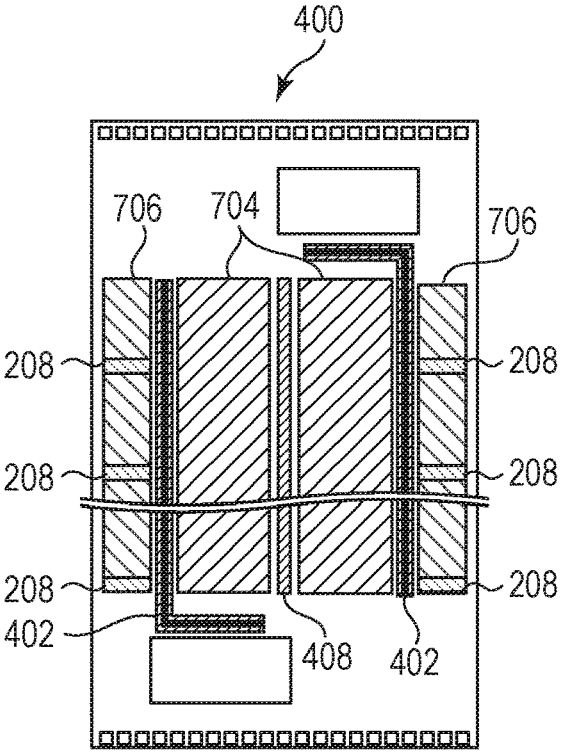

Referring to FIGS. 7A to 7C and 8A and 8B, some specific layout examples of the present embodiment will be illustrated. In FIGS. 7A and 7B, an ink inlet 408 is formed in the longitudinal direction of the recording element substrate 400 and ejection module lines 704 are disposed in at least one line on at least one side of the ink inlet 408. Similarly, memory module lines 706 are disposed on at least one side along the ink inlet. In the memory module line 706, at least one of the memory correction modules 208 is disposed. Between the ejection module line 704 and the memory module line 706, a common logic bus wire 402 is disposed and transmits a corresponding control signal to each module.

Figure 7C:
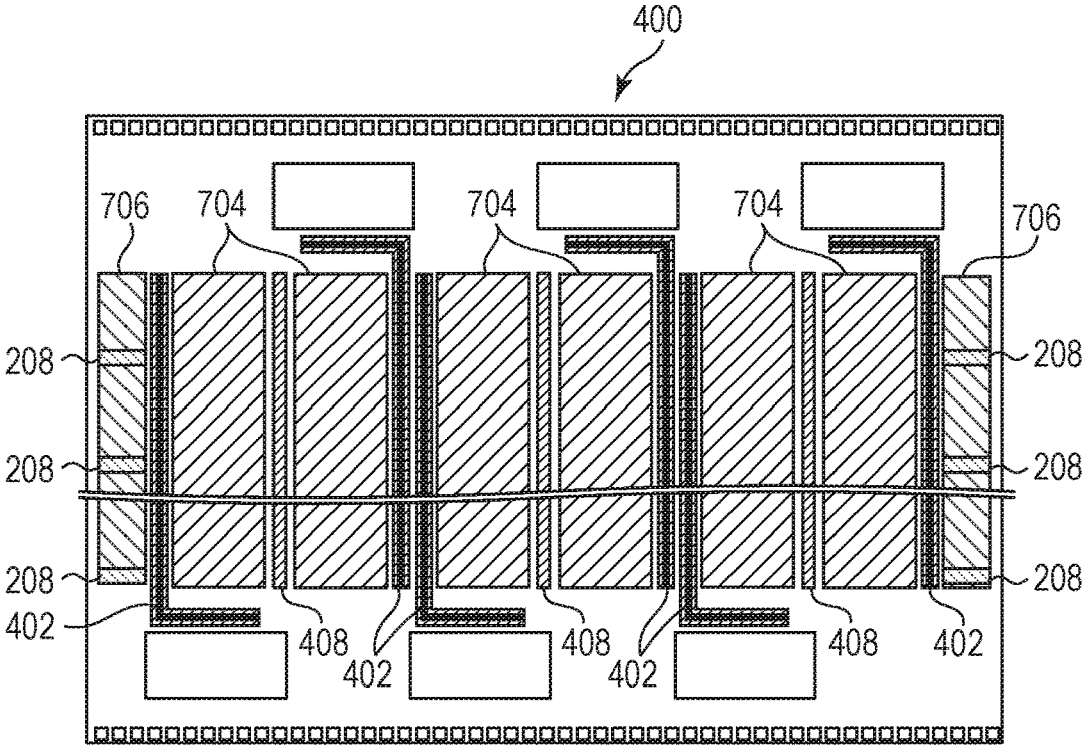

As illustrated in FIG. 7C, in the configuration including the multiple ink inlets 408, the memory module line 706 including the memory correction modules may be disposed on each of the outermost ends of the parallel arrangement of the ink inlets 408 so as to be parallel to the ink inlets 408.

Figure 8A:
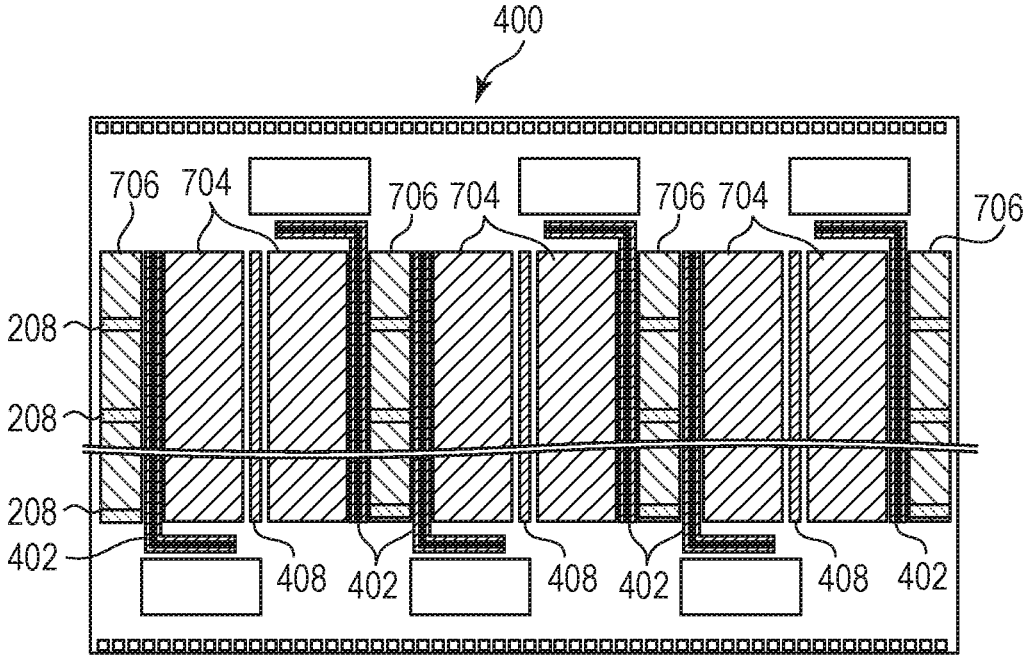
FIGS. 8A and 8B illustrate circuit configurations of the recording element substrate according to the second embodiment.
Figure 8B:
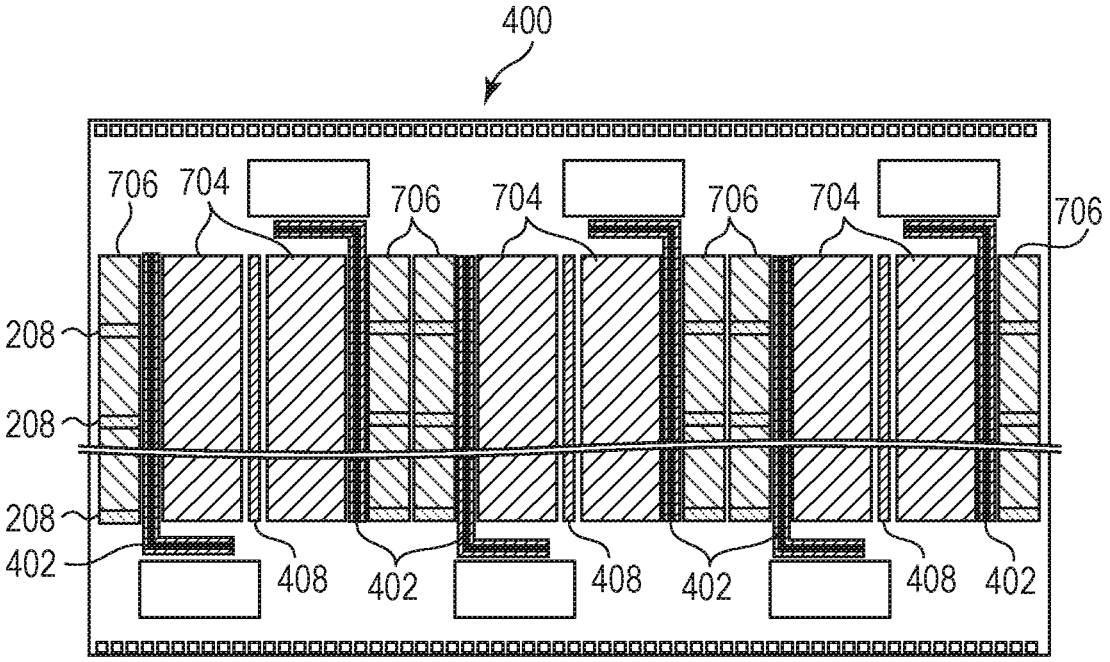

As illustrated in FIG. 8A, in the configuration including the multiple ink inlets 408, the k ink inlets 408 disposed in parallel and the (k+1) memory module lines 706 may be alternately disposed in the arrangement of the memory module lines 706. The memory module line 706 disposed between the two ink inlets 408 has common logic bus wires 402 that are adjacent to both sides of the memory module line 706. The memory module line 706 is electrically connected to at least one of the common logic bus wires 402. Alternatively, as illustrated in FIG. 8B, the multiple memory module lines 706 may be disposed in parallel between the two ink inlets 408.

Third Embodiment

Figure 9:
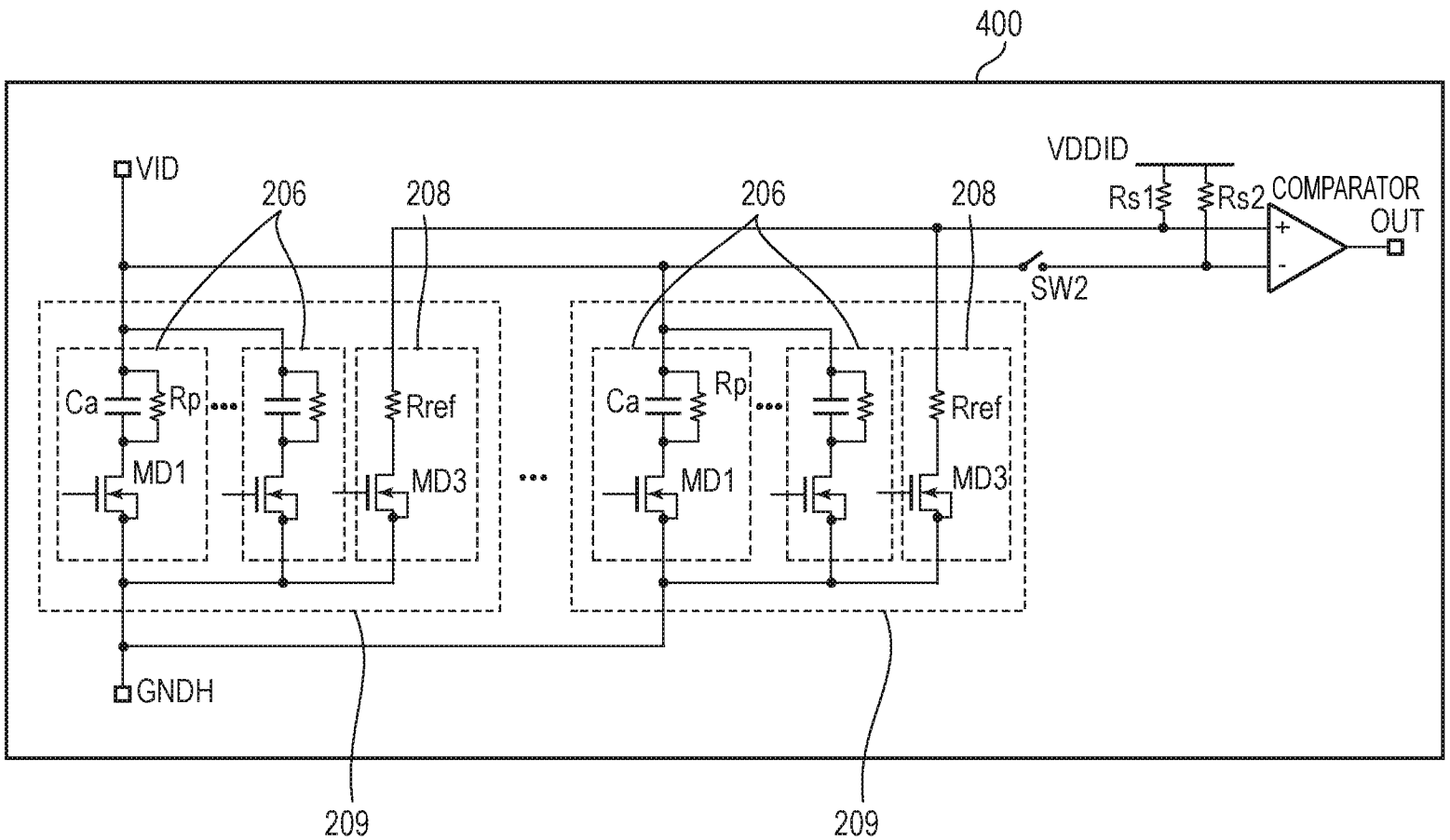
FIG. 9 illustrate the circuit configuration of a recording element substrate according to a third embodiment.

Referring to FIG. 9, a third embodiment will be described below. FIG. 9 illustrates the circuit configuration of a recording element substrate according to a third embodiment. The present embodiment features a recording element substrate 400 including a circuit that determines whether writing is performed on an antifuse element Ca or not. A memory module 206 and a memory correction module 208 are identical in configuration to the modules of the first embodiment and the second embodiment and thus the explanation thereof is omitted. The third embodiment is different from the second embodiment in that the power supply nodes of the multiple memory modules 206 and the power supply node of at least one memory correction module are separately connected to the input terminal of a comparator. SW is connected between the memory modules 206 and the input terminal of the comparator. SW is turned off during writing so as to prevent the application of a high-voltage VID (e.g., 24 V) to the input terminal of the comparator. The input terminal of the comparator is connected to a reading power supply VDDID via resistances Rs1 and Rs2 for generating comparison voltages. SW is turned on during reading, so that voltages determined by the memory module and the memory correction module are inputted to the comparator. Specifically, Vmem determined by Rs2 and the resistance value of the memory module is input to the negative terminal of the comparator, whereas Vref determined by Rs1 and the divided voltage of the resistance value of the memory correction module is input to the positive terminal of the comparator. Writing is rated by an output OUT logic of the comparator. When writing has not been performed, "Low" is output from the comparator. When writing has been completed, "High" is output from the comparator. At this point, Rref, R1 and R2 are desirably adjusted to set a judgment threshold value at a proper value as in the first embodiment.

Also for the resistances Rs1 and Rs2 for generating comparison voltages, configurations are identical to configurations for the memory reference resistance Rref and the parallel resistance Rp. The memory reference resistance Rref and the resistances Rs1 and Rs2 for generating comparison voltages are changed according to the resistance value of the parallel resistance Rp, thereby preventing reliability from decreasing during reading. The same configuration specifically means the same diffusion resistor and more preferably a design having the same width and length.

The present disclosure can reduce the occurrence of faulty reading of the antifuse element.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-247776, filed Dec. 28, 2018, which is hereby incorporated by reference herein in its entirety.

What is claimed is:

1. A recording element substrate for a liquid ejection head, comprising:
- a storage section, including
  - an antifuse element,
  - a first resistor connected in parallel with the antifuse element, and
  - at least one second resistor connected in parallel with the storage section and serves as a reference in rating information of the antifuse element; and
- a terminal for outputting a voltage of the first resistor and a voltage of the at least one second resistor to outside of the recording element substrate,
- wherein the timing of outputting the voltage of the first resistor from the terminal differs from the timing of outputting the voltage of the at least one second resistor from the terminal.

2. The recording element substrate according to claim 1, further comprising:
- a judgment section that rates information stored in the storage section, the information being rated based on a voltage of the first resistor and a voltage of the at least one second resistor.

3. The recording element substrate according to claim 1, further comprising:
- a first switch connected to the storage section; and
- a second switch connected to the at least one second resistor.

4. The recording element substrate according to claim 3, wherein the first and second switches are transistors.

5. The recording element substrate according to claim 4, wherein the transistors are MOS transistors.

6. The recording element substrate according to claim 1, further comprising: a selection circuit that selects one of the first resistor and the at least one second resistor.

7. The recording element substrate according to claim 6, wherein the selection circuit includes a signal line for selecting one of the first resistor and the at least one second resistor.

8. The recording element substrate according to claim 1, wherein the first resistor and the at least one second resistor are diffusion resistors having the same resistance value.

9. The recording element substrate according to claim 1, wherein the at least one second resistor includes a plurality of second resistors, and the at least one second resistor is near the antifuse element and used when a state of the antifuse element is to be rated.

10. The recording element substrate according to claim 1, further comprising:
- an ink inlet for supplying a liquid to an ejection orifice for ejecting the liquid,
- wherein the ink inlet is formed in a longitudinal direction of the recording element substrate, and
- wherein the storage section is disposed on at least one side of the ink inlet and along the ink inlet.

11. A liquid ejection head comprising:
- a recording element substrate for a liquid ejection head, wherein the recording element substrate includes:
- a storage section, including
  - an antifuse element,
  - a first resistor connected in parallel with the antifuse element, and a second resistor connected in parallel with the storage section and serves as a reference in rating information of the antifuse element; and a terminal for outputting a voltage of the first resistor and a voltage of the second resistor to outside of the recording element substrate, wherein the timing of outputting the voltage of the first resistor from the terminal differs from the timing of outputting the voltage of the second resistor.

12. A recording apparatus comprising:

a recording element substrate for a liquid ejection head and a judgment section, wherein the recording element substrate includes:

a storage section including an antifuse element a first resistor connected in parallel with the antifuse element, and a second resistor that is connected in parallel with the storage section and serves as a reference in rating information of the antifuse element; and a terminal for outputting a voltage of the first resistor and a voltage of the second resistor to outside of the recording element substrate, wherein the judgment section rates information stored in the storage section, the information being rated based on a voltage of the first resistor and a voltage of the second resistor, and wherein the timing of outputting the voltage of the first resistor differs from the timing of outputting the voltage of the second resistor.

* * * * *